US005201839A

United States Patent [19]

Swisher, Jr.

[11] Patent Number: 5,201,839

[45] Date of Patent: Apr. 13, 1993

[54] COUNTERCURRENT DRUM MIXER WITH SECOND HEAT SOURCE

[75] Inventor: George W. Swisher, Jr., Oklahoma City, Okla.

[73] Assignee: CMI Corporation, Oklahoma City, Okla.

[21] Appl. No.: 762,055

[22] Filed: Sep. 19, 1991

Related U.S. Application Data

[63] Continuation of Ser. No. 581,242, Sep. 7, 1990, abandoned, which is a continuation of Ser. No. 351,371, May 15, 1989, abandoned.

[51] Int. Cl.[5] ..... B01F 3/20

[52] U.S. Cl. ..... 366/4; 366/25; 366/7; 366/15

[58] Field of Search ..... 366/7, 6, 15, 23, 25, 366/22, 27, 33, 34, 40, 42, 57, 58, 4, 228; 432/14, 21, 105, 106, 111, 117, 118; 34/33, 132, 136, 137, 122; 106/281.1

[56] References Cited

U.S. PATENT DOCUMENTS

| | | | |
|---|---|---|---|
| Re. 29,496 | 12/1977 | Dydzyk | 366/25 |
| Re. 31,904 | 6/1985 | Mendenhall | 366/25 |
| 1,727,340 | 9/1929 | Flory | 366/23 |
| 3,025,611 | 3/1962 | Preeman | 432/111 X |
| 4,075,710 | 2/1978 | Jakob et al. | 366/25 |
| 4,096,588 | 6/1978 | Mendenhall | 366/7 |
| 4,142,803 | 3/1979 | Mendenhall | 366/25 |
| 4,189,238 | 2/1980 | Mendenhall | 366/7 |
| 4,190,370 | 2/1980 | Brock et al. | 366/25 |
| 4,326,809 | 4/1982 | Mendenhall | 432/105 X |
| 4,346,523 | 8/1982 | Ronning | 34/129 X |
| 4,375,959 | 3/1983 | Powell | 432/223 |
| 4,387,996 | 6/1983 | Mendenhall | 366/7 X |
| 4,540,287 | 9/1985 | Servas et al. | 366/25 X |
| 4,546,711 | 10/1985 | Kerwin | 432/14 X |
| 4,600,379 | 7/1986 | Elliott | 366/25 X |
| 4,705,404 | 11/1987 | Bruggemann | 366/25 X |
| 5,054,931 | 10/1991 | Farnham et al. | 366/25 |

FOREIGN PATENT DOCUMENTS

| | | | |
|---|---|---|---|
| 3333673 | 4/1985 | Fed. Rep. of Germany | 366/25 |

OTHER PUBLICATIONS

Brock, J. Don, "Energy Conservation on Asphalt Plants", 1980 (month unknown) copyright Astec Industries, Inc.

*Primary Examiner*—Frankie L. Stinson
*Attorney, Agent, or Firm*—Dunlap, Codding & Lee

[57] ABSTRACT

An asphalt production system utilizing a pair of rotatable drums for producing an asphaltic composition is provided. The asphaltic composition is produced by separately heating a volume of virgin aggregate material in a countercurrent drum dryer and heating a volume of recycle material in a parallel flow drum mixer. The hot virgin aggregate material is mixed with the heated recycle material at an intermediate location within the parallel flow drum mixer. A ducting system is provided for interconnecting the ends of the drums such that the hot exhaust gases from one drum are circulated into the other drum thus producing a common flow of exhaust gases between the drums.

10 Claims, 2 Drawing Sheets

COUNTERCURRENT DRUM MIXER WITH SECOND HEAT SOURCE

This application is a continuation of application Ser. No. 07/581,242, filed Sep. 7, 1990 and entitled: "COUNTERCURRENT DRUM MIXER WITH SECOND HEAT SOURCE" now abandoned, which is a continuation of application Ser. No. 07/351,371, filed May 15, 1989 and entitled: "COUNTERCURRENT DRUM MIXER WITH SECOND HEAT SOURCE" now abandoned.

BRIEF SUMMARY OF THE INVENTION

1. Field of Invention

The present invention relates generally to drum mixers used for producing an asphaltic composition.

2. Background of the Invention

In the present state of the art of making hot mix asphalt in a drum mixer type of plant wherein a portion of the materials used in making the composition comprises recycle asphalt, there are basically two types of drums; a parallel-flow drum and a counter-flow drum.

A parallel-flow drum is represented by U.S. Pat. Nos. Re: 31,904 and 31,905. In such a parallel-flow drum, the burner is located at the higher, input end of the drum where virgin aggregate is introduced, such that the virgin aggregate flow is parallel with the flow of the hot gases of combustion. Recycle material is introduced at a cooler zone of the drum and flows, along with the hot virgin aggregate, parallel to the flow of he hot gases of combustion, such that the recycle material is heated both by contact with the hot virgin aggregate and the gases of combustion.

A counter-flow drum is represented by U.S. Pat. No. 4,787,938. In this type of drum, the burner is located at an intermediate point in the drum with the hot gases of combustion flowing toward the higher, input end of the drum where the virgin aggregate is introduced. Thus, the virgin aggregate and hot gases of combustion are in a counter-flowing relation. The recycle material is introduced into the drum downstream from the burner, with the hot virgin aggregate and the recycle material being mixed in the drum downstream from the burner. In this type of drum, the recycle material is heated solely, or almost solely, by contact with the hot virgin aggregate. A similar process is carried out in what is known in the art as a double barrel arrangement where the hot virgin aggregate is discharged from the lower end of a rotating drum outwardly into a housing surrounding a portion of the drum, and the recycle material is introduced into the housing around the rotating drum for mixture with the hot virgin aggregate. Here again, the recycle material is heated almost solely by the hot virgin aggregate.

In the present invention a pair of drums are utilized for producing hot mix asphalt. In the first drum, a flame is located at the lower discharge end of the drum to direct a flow of hot combustion gases toward the upper, input end of the drum. Virgin aggregate, introduced into the input end of the first drum, flows countercurrent to the flow of hot combustion gases within the first drum. The hot virgin aggregate is conveyed from the discharge end of the first drum to an intermediate location in the second drum.

The second drum has a flame located at the higher input end thereof to direct a flow of hot combustion gases toward the lower, discharge end thereof. Recycle asphalt material, introduced into the input end of the second drum, flows parallel to the flow of hot combustion gases within the second drum. The recycle material is heated by the flow of the hot gases in the second drum and by contact with the hot virgin aggregate. Means are also provided for producing a common flow of hot gases between the first and the second drums.

DESCRIPTION OF THE PREFERRED EMBODIMENTS

Figure 1:
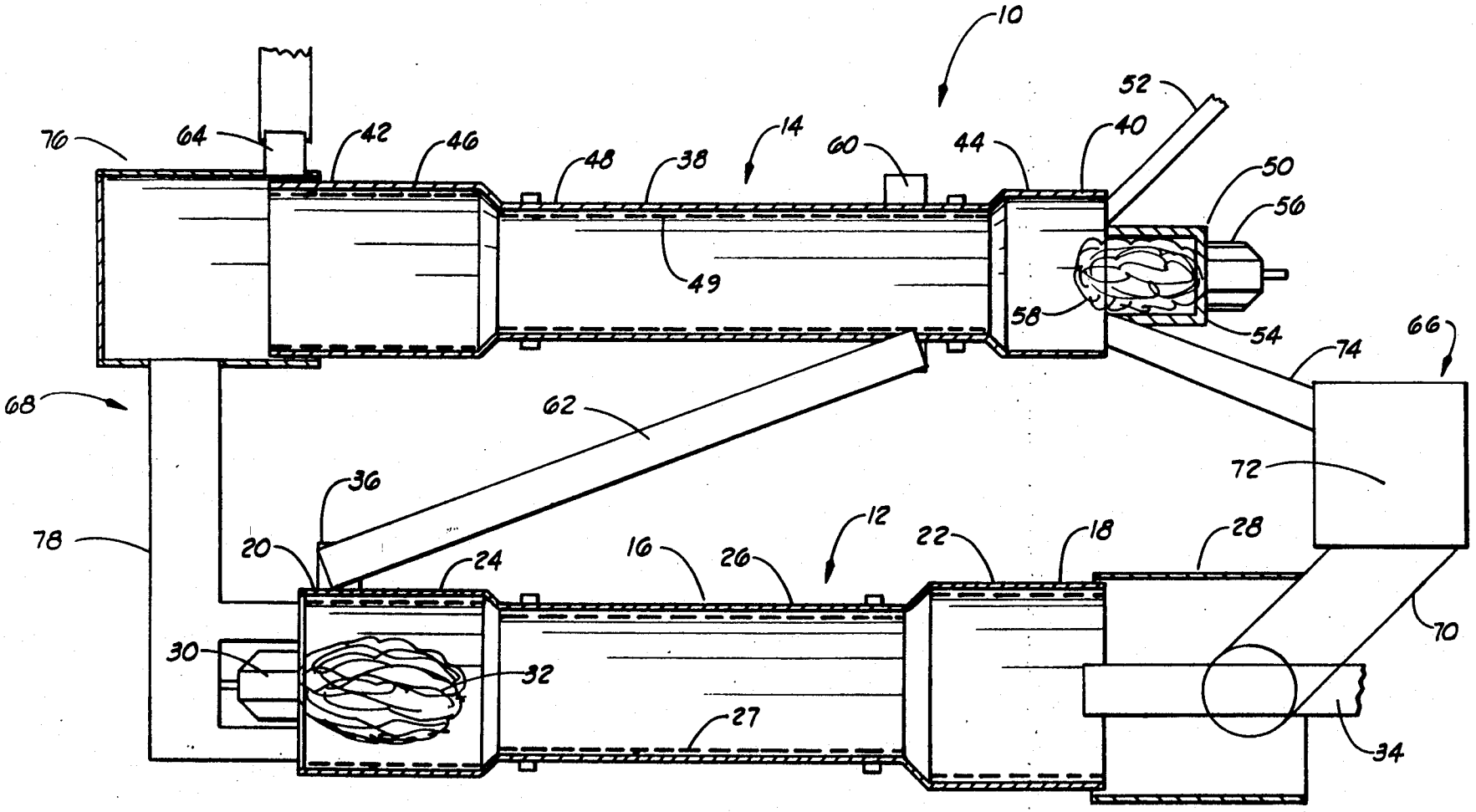
FIG. 1 is a schematic view of an asphalt production system constructed in accordance with the present invention, illustrating each drum in horizontal cross-section.

As shown in FIG. 1, the present invention comprises an asphalt production system designated generally by the reference numeral 10. The asphalt production system 10 includes a drum dryer 12 and a drum mixer 14.

The drum dryer 12 includes a drum 16 having a first end 18 and a second end 20. It will be understood that the drum 16 is positioned in a slightly inclined position wherein the level of the first end 18 is above the level of the second end 20. It will be further understood that the drum 16 may be rotated in this position by a conventional drive system (not shown).

The drum 16 further includes expanded portions 22 and 24, extending from the first end 18 and the second end 20 respectively, and a smaller diameter intermediate portion 26. A plurality of mixing flights 27 are secured within the drum 16 and extend substantially the length thereof. The drum 16 also includes a conventional exhaust collection system 28 and burner assemble 30 for generating a flame 32.

The exhaust collection system 28 is sized for overlying the first end 18 of the drum 16 such that the first end 18 rotates freely therein. The exhaust collection system 28 prevents pollutants exiting the drum 16 from escaping into atmosphere.

The drum dryer 12 also includes a conveyor 34 positioned at the first end 18 thereof and a discharge structure 36 at the second end 20 thereof. The conveyor 34 extends into the first end 18 of the drum 16 for introducing virgin aggregate into the drum 16.

The drum mixer 14 includes a drum 38 having a first end 40 and a second end 42. It will be understood that the drum 38 is positioned in a slightly inclined position wherein the level of the first end 40 is above the level of the second end 42. It will be further understood that the drum 38 may be rotated in this position by a conventional drive system (not shown).

The drum 38 further includes expanded portions 44 and 46, extending from the first end 40 and the second end 42 respectively, and a smaller diameter intermediate portion 48. The drum 38 also includes a plurality of mixing flights 49 secured to and extending substantially the length thereof.

At the first end 40, the drum 38 includes a conveyor 52 and a burner assembly 50. The conveyor 52 extends into the first end 40 of the drum 38 for introducing recycle asphalt material, therein.

The burner assembly 50 includes a combustion chamber 54 and a burner 56 for creating a flame 58. The combustion chamber 54 is shaped such that the recycle asphalt material entering the drum 38 via the conveyor 52 is substantially shielded from exposure to the flame 58.

The drum 38 also includes a material entry collar 60 between the first end 40 and the second end 42 thereof. The heated virgin aggregate material exiting the discharged structure 36 of the drum dryer 12 is transported to the material entry collar 60 of the drum mixer 14 via a conveyor 62. The heated virgin aggregate material enters drum mixer 14 through the material entry collar 60.

The drum mixer system 10 further includes a first duct assembly 66 and a second duct assemble 68. The first duct assembly 66 includes an exhaust duct 70, a heat exchanger 72 and an return duct 74. The exhaust duct 70 conveys at least a portion of the hot gases exiting the exhaust collection system 28 to the heat exchanger 72. It is understood that the heat exchanger 72 may be a condenser or other suitable structure designed, for example, to preheat materials used to produce the asphaltic composition. The return duct 74 conveys the hot gases exiting the heat exchanger 72 to the drum mixer 14.

The second duct assembly 68 includes a closed end collar 76 and an interconnecting exhaust duct 78. The collar 76, sized for overlying the second end 42 of the drum 38 such that the second end 42 rotates freely therein, collects the hot gases and pollutants exiting the drum 38. These gases and pollutants are conveyed from the collar 76 into the drum 16 through the interconnecting exhaust duct 78.

In accordance with the present invention, the method for continuously producing an asphaltic composition preferably is carried out by introducing virgin aggregate material into the rotating drum 16 at the first end 18 thereof. As the virgin aggregate material flows from the first end 18 to the second end 20 of the drum 16 it is lifted by the mixing flights 27 such that curtains of falling material are created within the drum 16.

The virgin aggregate material is heated within the drum dryer 12 by a first stream of hot gases produced by the flame 32. The hot gases produced by the flame 32 flow from the second end 20 to the first end 18 within the drum 16 in a countercurrent direction to the flow of the virgin aggregate material within the drum 16.

Recycle material is introduced into the rotating drum 38 at the first end 40 thereof and flows from the first end 40 to the second end 42. The recycle material is heated within the drum 38 by a second stream of hot gases produced by the flame 58. The second stream of hot gases flow from the first end 40 to the second end 42 of the drum 38 in a parallel direction to the flow of recycle material within the drum 38.

The hot virgin aggregate discharged from the drum dryer 12 is conveyed to the material entry collar 60 of the drum mixer 14 as described above. The hot virgin aggregate is combined and mixed with the recycle material as the hot virgin aggregate enters the drum 38 through the material entry collar 60. In addition to the transfer of heat by conduction between the two materials, the mixing materials are further heated within the drum 38 by the second stream of hot gases. As the mixing materials progress towards the second end 42 of the drum 38, they are lifted by the flights 49 such that curtains of falling materials are created therein.

The virgin aggregate material may be fed to the mixer drum 38 if desired, rather than recycle material. It is understood that, depending upon the composition of the materials utilized in this process, a certain quantity of liquid asphalt sufficient to produce an asphalt composition will be injected into the drum 38 through a liquid asphalt injection line (not shown). The resulting asphaltic composition is discharged from the second end 42 of the drum 38 through the discharge structure 64.

During the above process, the first stream of hot gases exiting the first end 18 of the drum 16 may be conveyed through the first duct assembly 66 into the first end 40 of the drum 38 as described above. Likewise, the second stream of hot gases exiting the second end 42 of the drum 38 may be conveyed through the second duct assembly 68 into the second end 20 of the drum 16. In this way, a continuous stream of hot gases between the drum 16 and the drum 38 is created. Also, any combustible materials which may be in the exhaust stream from the mixer drum 14 will be directed into the flame 32 and burned.

Figure 2:
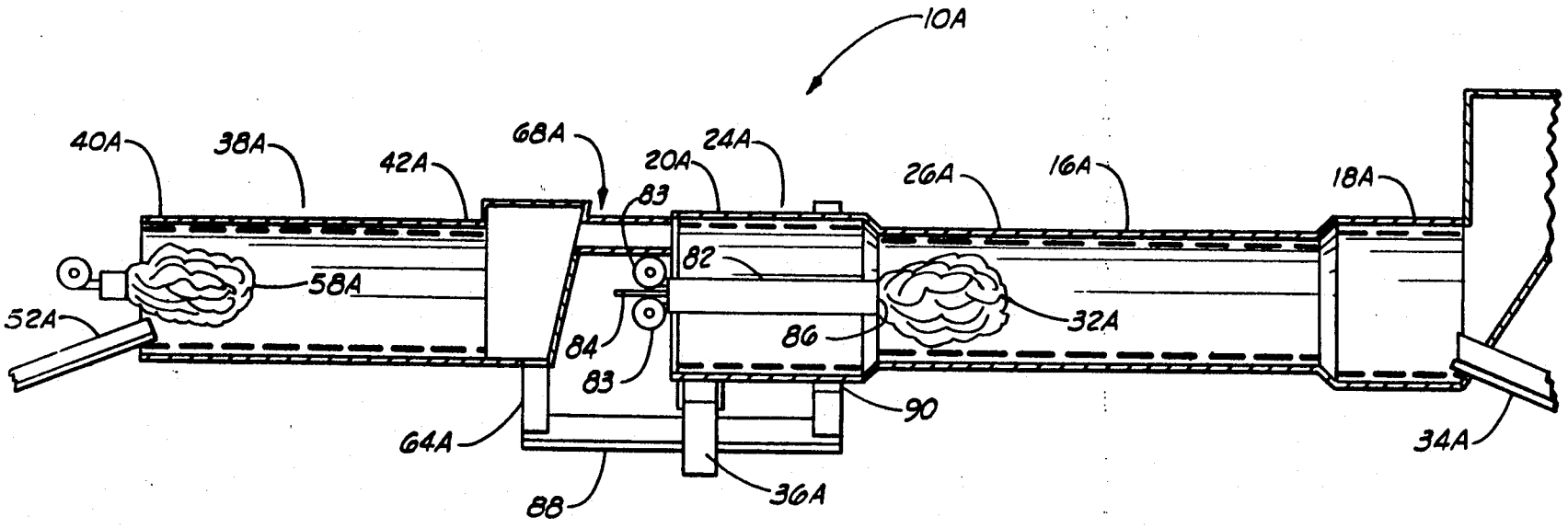
FIG. 2 is a semi-schematic vertical cross-sectional view of a modified asphalt production system.

The asphalt production system 10A shown in FIG. 2, is similar to the asphalt production system 10 shown in FIG. 1, except that a burner assembly 80, portions of which extend into the drum 16A from the second end 20A thereof, is provided for creating a flame 32A at an intermediate location within the drum 16A. As believed will be apparent, the plant components shown in FIG. 2 corresponding to the components in FIG. 1 have the same reference numbers with an A added.

The burner assembly 80, includes a tube 82, a pair of blowers 83, a fuel line 84 extending substantially the length of the tube 82 and a burner head 86 positioned substantially at the interface between the expanded portion 24A and the smaller diameter portion 26A. Additionally, recycle material and virgin aggregate material are mixed in the expanded portion 24A of the drum 16A.

The recycle material is introduced into the first end 40A of the drum 38A by the conveyor 52A in a manner so as not to expose said material to the flame 58A. The recycle material flows towards the second end 42A of the drum 38A in a parallel direction with the stream of hot gases produced by the flame 58A. The virgin aggregate material may be fed into the drum 38A of the asphalt production system 10A if desired, rather than recycle material.

The virgin aggregate material is introduced into the first end 18A of the drum 16A by the conveyor 34A. The virgin aggregate material flows towards the second end 20A of the drum 16A in a countercurrent direction to the stream of hot gases produced by the flame 32A.

The heated recycle material, exiting the drum 38A through a discharge structure 64A, is conveyed to the drum 16A by a conveyor 88. The heated recycle material enters the expanded portion 24A of the drum 16A through a material entry collar 90 between the flame 32A and the second end 20A of the drum 16A.

The heated recycle material and the hot virgin aggregate material mix in the expanded portion 24A and flow towards the second end 20A of the drum 16A. The flow of mixing materials in the expanded portion 24A is countercurrent to the stream of hot gases exiting the drum 38A and entering the drum 16A via the second duct assembly 68A. Any combustible materials which may be in the exhaust stream from the drum 38A will be directed into the flame 32A and burned. The resulting asphaltic composition exits the drum 16A through the discharge structure 36A.

It is understood that the hot gases exiting the first end 18A of the drum 16A may be circulated into the first end 40A of the drum 38A in a similar manner as described above, by a ducting structure (not shown). It is further understood that, depending upon the composition of the materials utilized, a certain quantity of liquid asphalt sufficient to produce an asphaltic composition will be injected into the expanded portion 24A through a liquid asphalt injection line (not shown).

Changes may be made in the construction, operation, and arrangement of the various parts, elements, steps, and procedures described herein without departing from the spirit and scope of the invention as defined in the following claims.

What is claimed is:

1. An apparatus for producing an asphaltic composition comprising:

a first drum for heating virgin material wherein the first drum has a first end and a second end:

means for generating a first stream of hot gases in the first drum, wherein the first stream of hot gases flows toward the first end of the first drum;

means for introducing virgin material into the first end of the first drum wherein the virgin material flows toward the second end of the first drum;

a second drum for heating recycle material wherein the second drum has a first end and a second end;

means for generating a second stream of hot gases in the second drum, wherein the second stream of hot gases flows toward the second end of the second drum;

means for introducing recycle material into the first end of the second drum wherein the recycle material flows toward the second end of the second drum;

means for mixing the recycle material and the virgin material in one of said drums; and means for transferring virgin material from the first drum to the second drum.

2. The apparatus of claim 1 further comprising a material entry collar between the first and second end of the second drum for receiving virgin material.

3. The apparatus of claim 2 further comprising means for circulating the first stream of hot gases into the second drum.

4. The apparatus of claim 2 further comprising means for circulating the second stream of hot gases into the first drum.

5. The apparatus of claim 2 further comprising means for circulating a continuous stream of hot gases between the first drum and the second drum.

6. A method for producing an asphaltic composition comprising the steps of:

introducing virgin material into a first inclined rotating drum such that the virgin material flows through the first drum;

creating a first stream of hot gases;

directing the first stream of hot gases through the first drum such that the hot gases travel in the opposite direction as the virgin material;

introducing recycle material into a second inclined rotating drum such that the recycle material flows through the second drum;

creating a second stream of hot gases;

directing the second stream of hot gases through the second drum such that the hot gases travel in the same direction as the recycle material;

collecting the virgin material from the first drum;

mixing the collected virgin material with the recycle material by adding the collected virgin material to the second drum at an intermediate point on the second drum; and collecting the mixed materials from the second drum.

7. The method of claim 6 further comprising the step of adding liquid asphalt to the virgin and recycle materials while they are being mixed.

8. The method of claim 7 further comprising the step of directing the first stream of hot gases from the first drum into the second drum.

9. The method of claim 7 further comprising the step of directing the second stream of hot gases from the second drum into the first drum.

10. The method of claim 7 further comprising the step of directing the first stream of hot gases from the first drum into the second drum and directing the second stream of hot gases from the second drum into the first drum.

* * * * *